US009238262B2

(12) United States Patent
Lin et al.

(10) Patent No.: US 9,238,262 B2
(45) Date of Patent: Jan. 19, 2016

(54) HEAT-DISSIPATING DEVICE AND METHOD FOR MANUFACTURING THE SAME

(75) Inventors: Sheng-Huang Lin, New Taipei (TW); Kuo-Sheng Lin, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 353 days.

(21) Appl. No.: 13/610,501

(22) Filed: Sep. 11, 2012

(65) Prior Publication Data

US 2014/0034280 A1 Feb. 6, 2014

(30) Foreign Application Priority Data

Aug. 1, 2012 (TW) ..... 101127727 A

(51) Int. Cl.

| | |
|---|---|
| ***F21V 29/77*** | (2015.01) |
| ***B21D 53/06*** | (2006.01) |
| ***B21D 53/02*** | (2006.01) |
| *F28D 21/00* | (2006.01) |

(52) U.S. Cl.

CPC ..... *B21D 53/06* (2013.01); *B21D 53/02* (2013.01); *F21V 29/77* (2015.01); *F28D 2021/0029* (2013.01); *Y10T 29/49361* (2015.01); *Y10T 29/49378* (2015.01)

(58) Field of Classification Search

CPC ..... F21V 29/2231; F21V 29/77

USPC ..... 165/80.3, 128, 131, 183; 362/294

See application file for complete search history.

(56) References Cited

U.S. PATENT DOCUMENTS

| | | | | |
|---|---|---|---|---|
| 1,726,235 | A * | 8/1929 | Murray | 165/131 |
| 1,942,211 | A * | 1/1934 | Hartwig | 165/134.1 |
| 2,413,179 | A * | 12/1946 | Grandmont et al. | 165/185 |
| 4,889,181 | A * | 12/1989 | Meijer | 165/78 |
| 6,851,467 | B1 * | 2/2005 | Bamford et al. | 165/80.3 |
| 7,497,248 | B2 * | 3/2009 | Hegde | 165/80.3 |
| 8,196,643 | B2 * | 6/2012 | Chen | 165/80.3 |
| 2003/0048608 | A1 * | 3/2003 | Crocker et al. | 361/697 |
| 2011/0051430 | A1 * | 3/2011 | Chen | 362/373 |
| 2012/0118536 | A1 * | 5/2012 | Huang | 165/104.26 |

* cited by examiner

*Primary Examiner* — Allen Flanigan

(74) *Attorney, Agent, or Firm* — C. G. Mersereau; Nikolai & Mersereau, P.A.

(57) ABSTRACT

The present invention relates to a heat-dissipating device and a method for manufacturing the same. The heat-dissipating device includes a base and a first heat-dissipating fin. The outer periphery of the base has a trough. The first heat-dissipating fin has a first heat-dissipating portion, a first end and a second end. The first end and the second end are disposed in the trough. By a machining process, both ends of the first heat-dissipating fin are pressed into the trough of the base at a high speed, so that the base can be combined with the first heat-dissipating fin rapidly. In this way, the manufacture cost is reduced and the heat-dissipating efficiency is increased.

3 Claims, 19 Drawing Sheets

HEAT-DISSIPATING DEVICE AND METHOD FOR MANUFACTURING THE SAME

This application claims the priority benefit of Taiwan patent application number 101127727 filed on Aug. 1, 2012.

BACKGROUND OF THE INVENTION

1. Field of the Invention

The present invention relates to a heat-dissipating device and a method for manufacturing the same. More particularly, the present invention relates to a heat-dissipating device which can be assembled rapidly with reduced labor hours and manufacture cost, and also relates to a method for manufacturing such a heat-dissipating device.

2. Description of Prior Art

Conventional cylindrical heat sink includes a cylindrical body and a plurality of fins connected to the outer peripheral surface of the cylindrical body. In prior art, the fins are connected to the outer peripheral surface of the cylindrical body by the following methods:

(1) One prior art discloses a method for joining fins of a cylindrical heat sink and a device for implementing the method. The method includes steps of: providing a mold driven by a power source to generate stepping rotations; providing a cylindrical body positioned on the mold, the outer peripheral surface of the cylindrical body being provided with a plurality of troughs; providing a fin set comprising a plurality of fins, the fin set being assembled on one end of the mold, the intermittent rotation of the cylindrical body causing the troughs to be aligned with the fins, an inserting device being used to push the fins to be inserted into the troughs of the cylindrical body respectively; the fins are tightly joined with the troughs of the cylindrical body and positioned on the outer peripheral surface of the cylindrical body to thereby form a heat sink.

(2) Another prior art discloses a joining method for a heat sink. The heat sink includes a heat-conducting base and a fin set. One surface of the heat-conductive base is provided with a plurality of troughs and grooves formed between adjacent two of the troughs. The fin set has a plurality of fins. The method includes steps of: providing a forming die, the forming die having an internal space and a pressing end; pressing the forming die and the heat sink, so that the heat sink is inserted into the internal space of the forming die and the central axis of the pressing end is pressed into the groove to deform the troughs, the deformed troughs pressing the fins to join together. The above-mentioned pressing process is advantageous over the punching and riveting process used in the conventional heat sink by reducing the breakage of punch pins or forming dies, increasing the yield of products, having improved precision and quality. Further, the pressing process can be used to form various shapes of heat sinks.

According to the above-mentioned methods, a fin is first inserted into a trough, and a forming die is used to press the grooves on both sides of the trough to thereby deform the trough, so that the deformed trough can press the fin to tightly join together. However, such a pressing process has the following problems.

(1) The outer surface of the cylindrical body has to be provided with the troughs and the grooves in such a manner that the troughs and the grooves are spaced from each other. As a result, the number of the troughs on the outer surface of the cylindrical body is limited, which also limits the number of the fins fitted into the troughs.

(2) The conventional pressing process has more steps, and it takes more time to finish the final products.

Therefore, it becomes an important issue for the present Inventor to solve the problems and drawbacks of prior art.

SUMMARY OF THE INVENTION

An objective of the present invention is to provide a heat-dissipating device and a method for manufacturing the same, which uses compressed air to generate a high-speed press-fitting process.

In order to achieve the above objective, the present invention is to provide a heat-dissipating device comprising a base and at least one first heat-dissipating fin. The outer periphery of the base has at least one trough. The first heat-dissipating fin has a first heat-dissipating portion. Both ends of the first heat-dissipating portion has a first end and a second end. The first end and the second end are provided in the trough.

In order to achieve the above objective, the present invention further provides a method for manufacturing a heat-dissipating device, including steps of:

providing a forming die having a first accommodating trough and at least one second accommodating trough, the first accommodating trough being in communication with the second accommodating trough;

providing at least one heat-dissipating fin and a base having at least one trough on its outer periphery;

disposing the heat-dissipating fin in the second accommodating trough in such a manner that both ends of the heat-dissipating fin protrude from the second accommodating trough to extend into the first accommodating trough;

aligning one end of the base with the first accommodating trough, adjusting the trough to align with both ends of the heat-dissipating fin, high-speed punching the base into the first accommodating trough via a machining process, and pressing both ends of the heat-dissipating fin into the trough of the base, thereby combining the heat-dissipating fin with the base rapidly.

According to the present invention, the working hours for assembling the heat-dissipating device can be reduced greatly. Further, the yield of the final products is increased, and the manufacture cost is lowered.

The above objectives and structural and functional features of the present invention will be described in more detail with reference to preferred embodiment thereof shown in the accompanying drawings

DETAILED DESCRIPTION OF THE INVENTION

Figure 1:
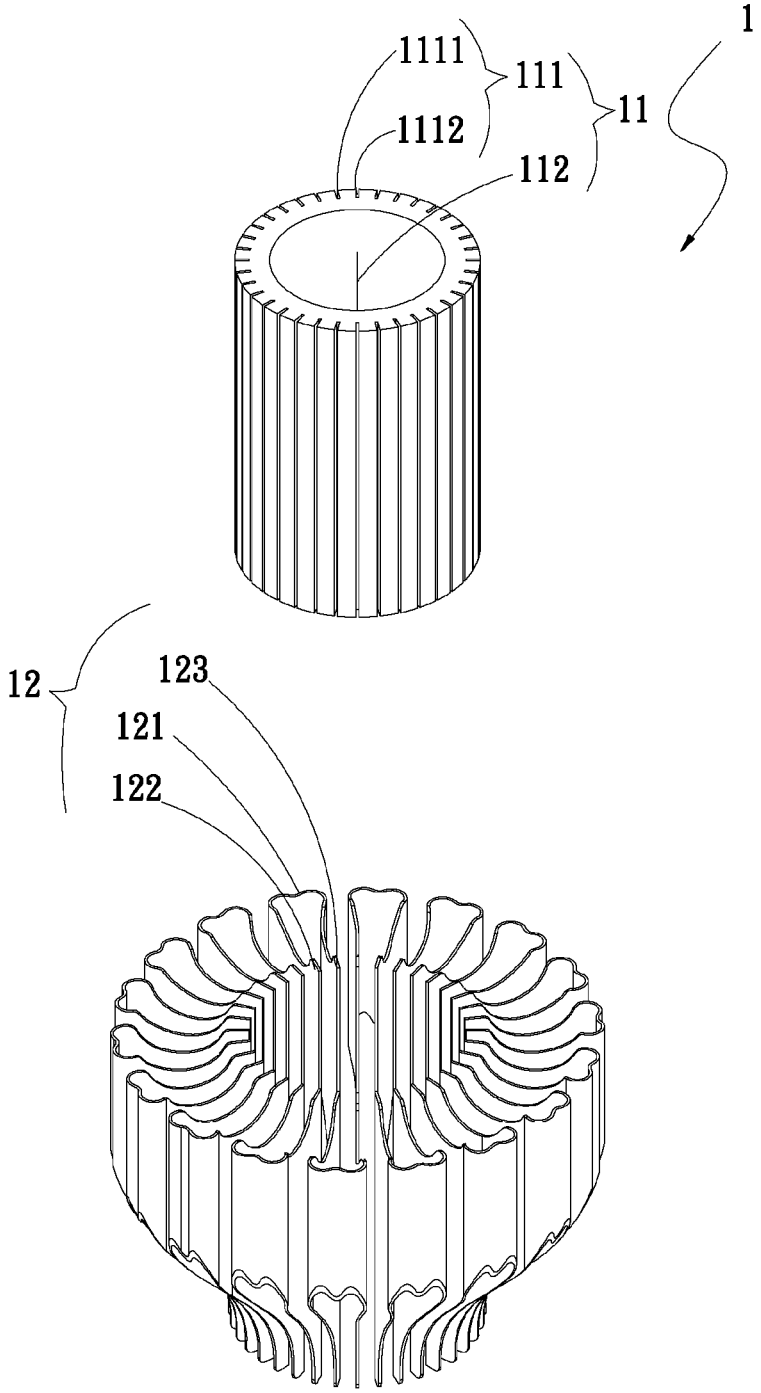
FIG. 1 is an exploded perspective view showing the heat-dissipating device according to a first embodiment of the present invention.
Figure 2:
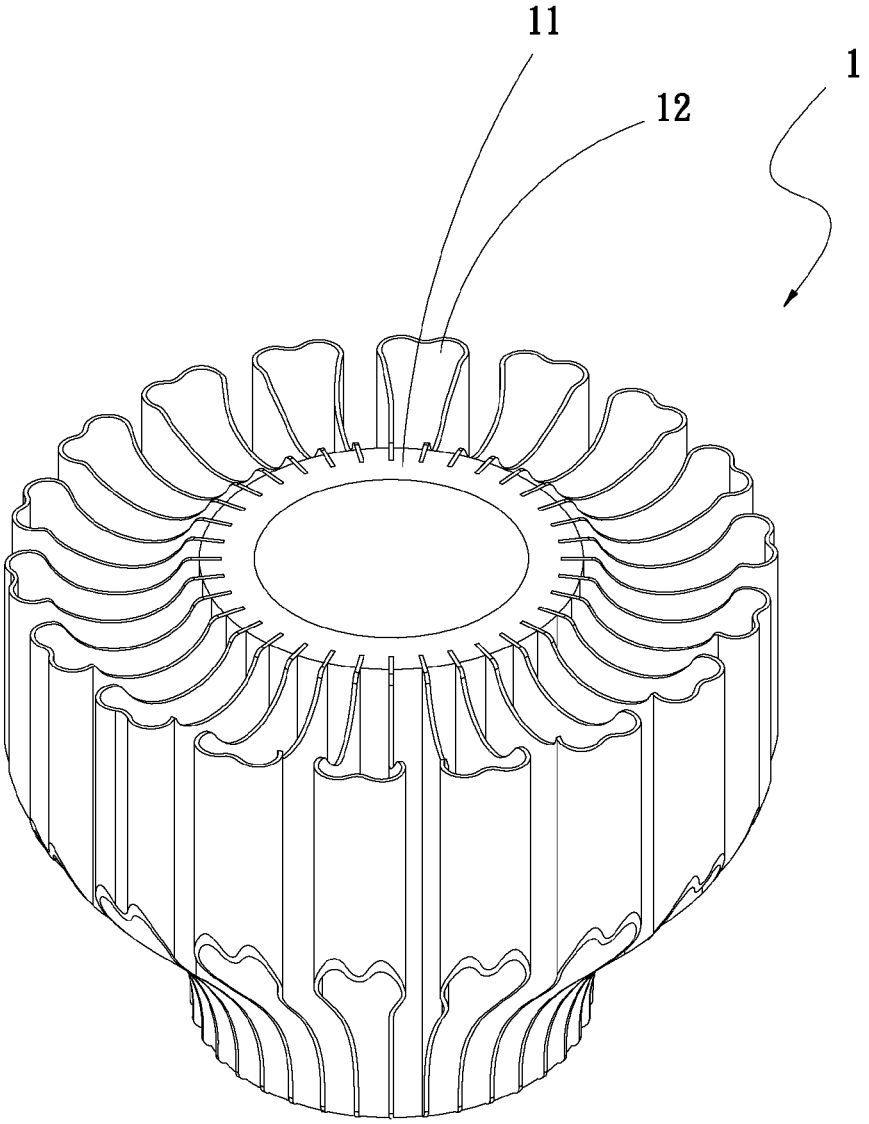
FIG. 2 is an assembled perspective view showing the heat-dissipating device according to the first embodiment of the present invention.

FIGS. 1 and 2 are an exploded perspective view and an assembled perspective view showing the heat-dissipating device according to the first embodiment of the present invention respectively. The heat-dissipating device 1 comprises a base 11 and at least one first heat-dissipating fin 12.

The base 11 has a trough 111. A central axis 112 is defined in the base 11. The trough 111 is in parallel to the central axis 112 and provided on an outer periphery of the base 11.

The first heat-dissipating fin 12 has a first heat-dissipating portion 121. Both ends of the first heat-dissipating portion 121 are formed with a first end 122 and a second end 123 respectively. The first end 122 and the second end 123 are provided in the trough 111.

In the present embodiment, the trough 111 further has a first insertion slot 1111 and a second insertion slot 1112. The first end 122 and the second end 123 are inserted into the first insertion slot 1111 and the second insertion slot 1112 respectively. The first heat-dissipating portion 121 may be configured as any one of a curved shape, a pointed shape, a waved shape, and a linear shape. In the present embodiment, the first heat-dissipating portion 121 is configured as a curved shape for example, but it is not limited thereto. The first heat-dissipating portion 121 may be bent to form a heart-like shape.

Figure 3:
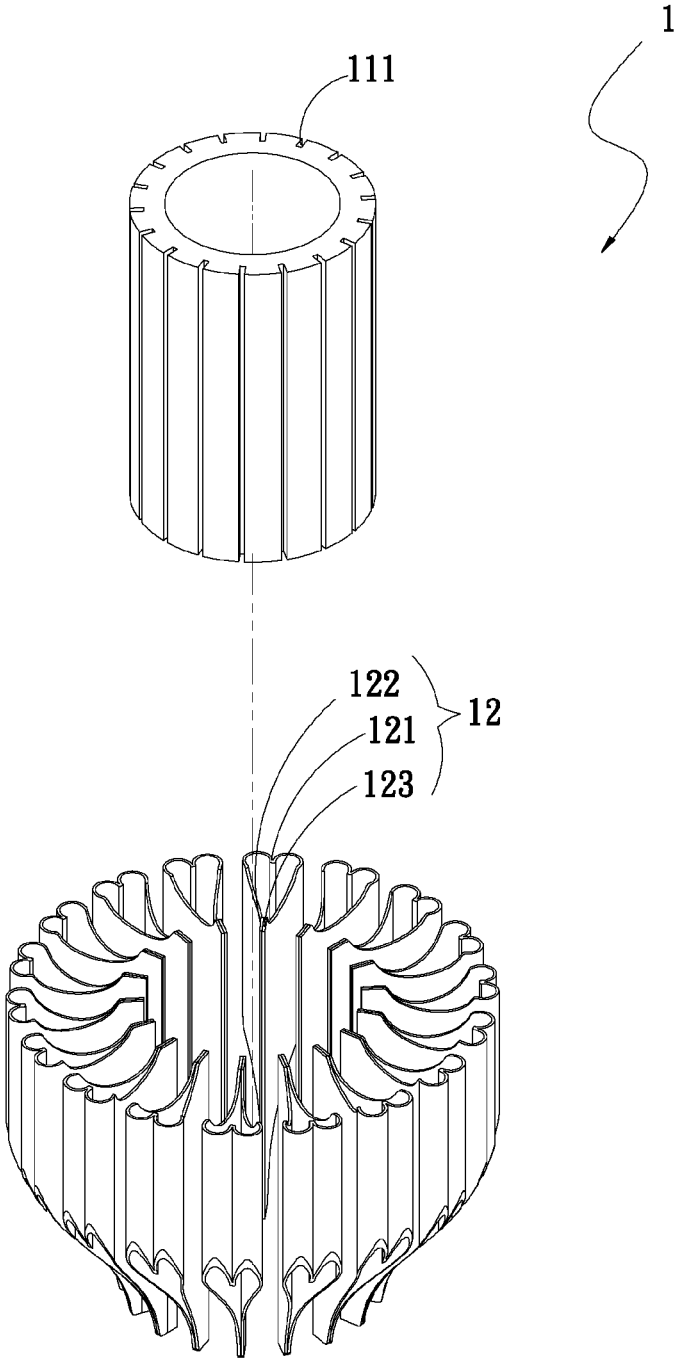
FIG. 3 is an exploded perspective view showing the heat-dissipating device according to a second embodiment of the present invention.
Figure 4:
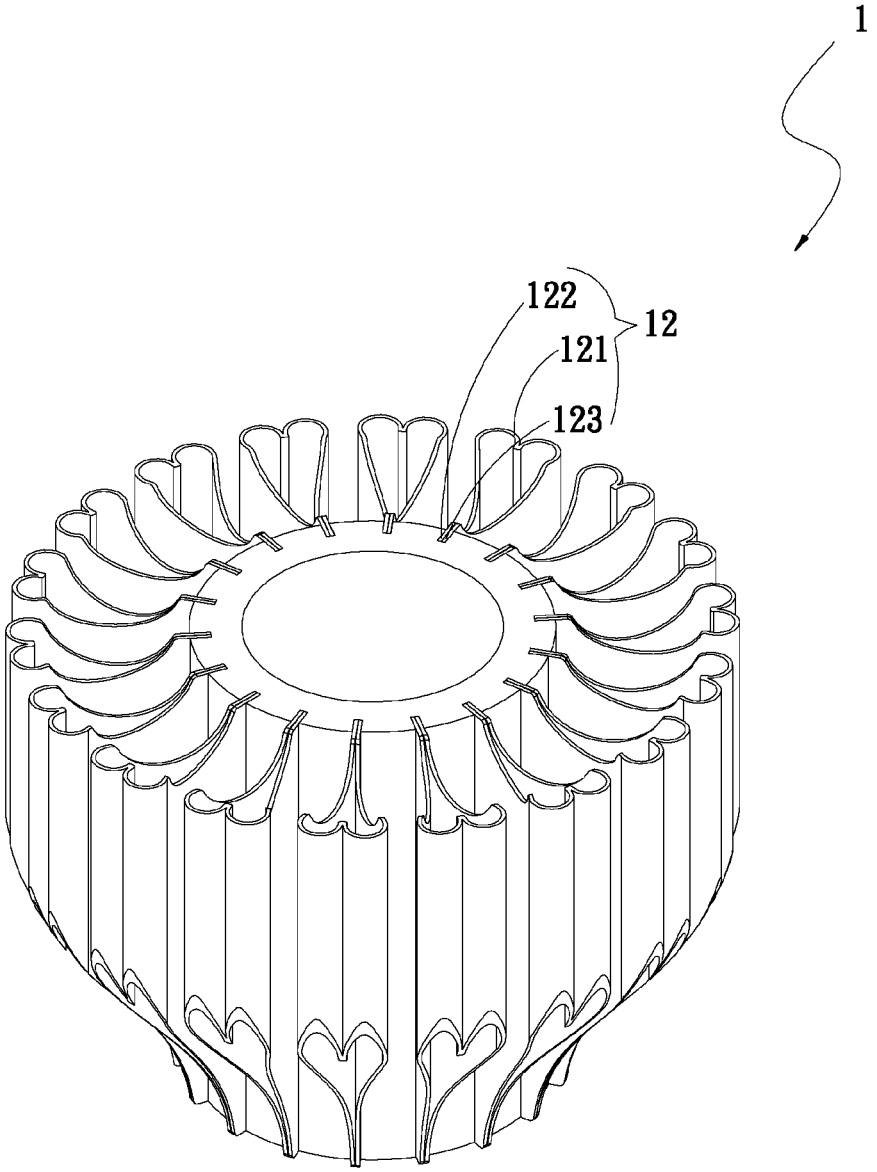
FIG. 4 is an assembled perspective view showing the heat-dissipating device according to the second embodiment of the present invention.

FIGS. 3 and 4 are an exploded perspective view and an assembled perspective view showing the heat-dissipating device according to the second embodiment of the present invention respectively. As shown in these figures, the structure of the second embodiment is substantially the same as that of the first embodiment, so that the redundant description is omitted for clarity. The difference between the second embodiment and the first embodiment lies in that: the first end 122 and the second end 123 of the first heat-dissipating fin 12 of the heat-dissipating device 1 are both disposed in the trough 111. The first heat-dissipating portion 121 is configured as any one of a curved shape, a pointed shape, a recessed shape, a waved shape, and a linear shape.

Alternatively, although not shown, the first end 122 of the first heat-dissipating fin 12 of the heat-dissipating device 1 and the second end 123 of another first heat-dissipating fin 12 can be both disposed in the trough 111.

Figure 5:
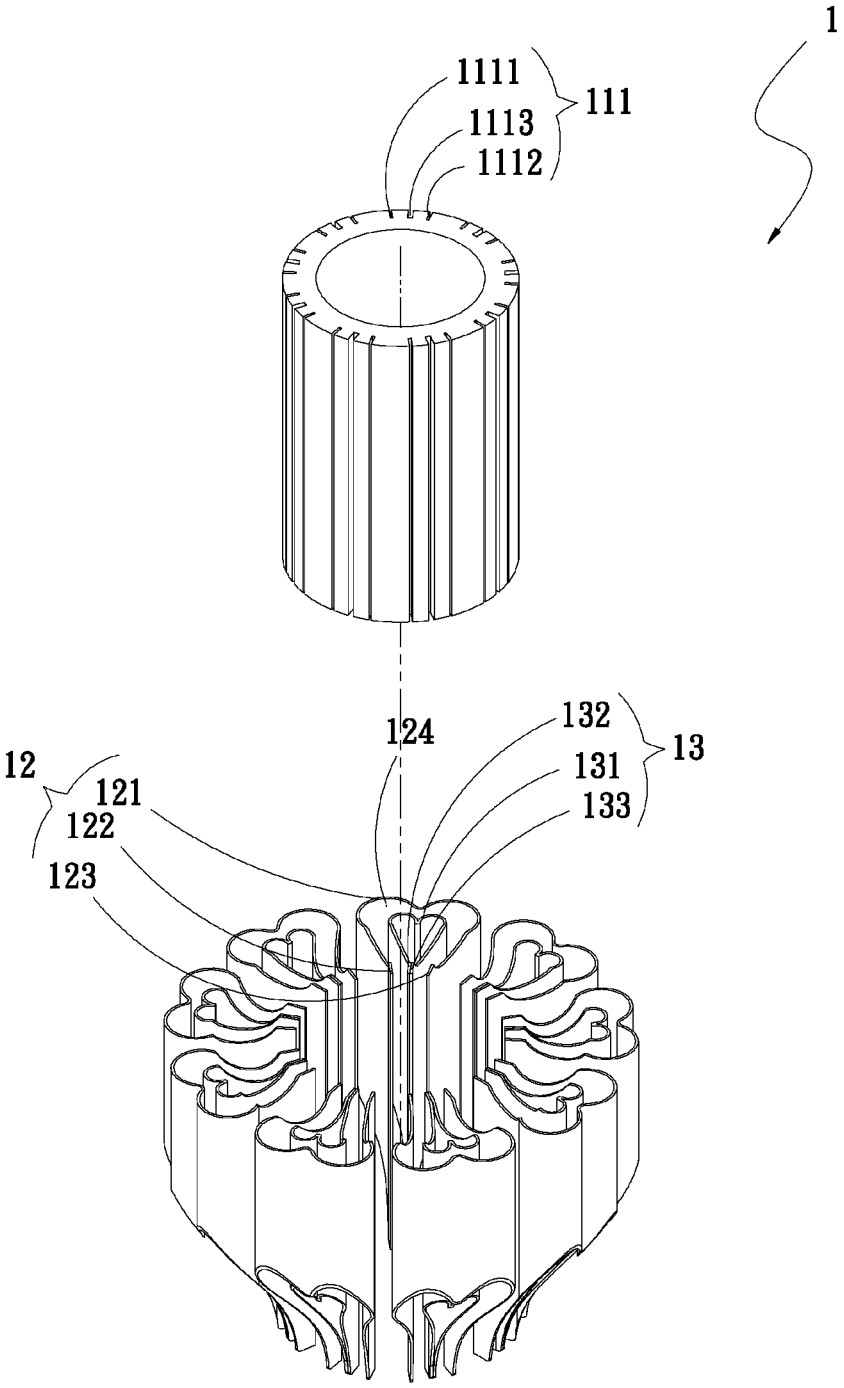
FIG. 5 is an exploded perspective view showing the heat-dissipating device according to a third embodiment of the present invention.
Figure 6:
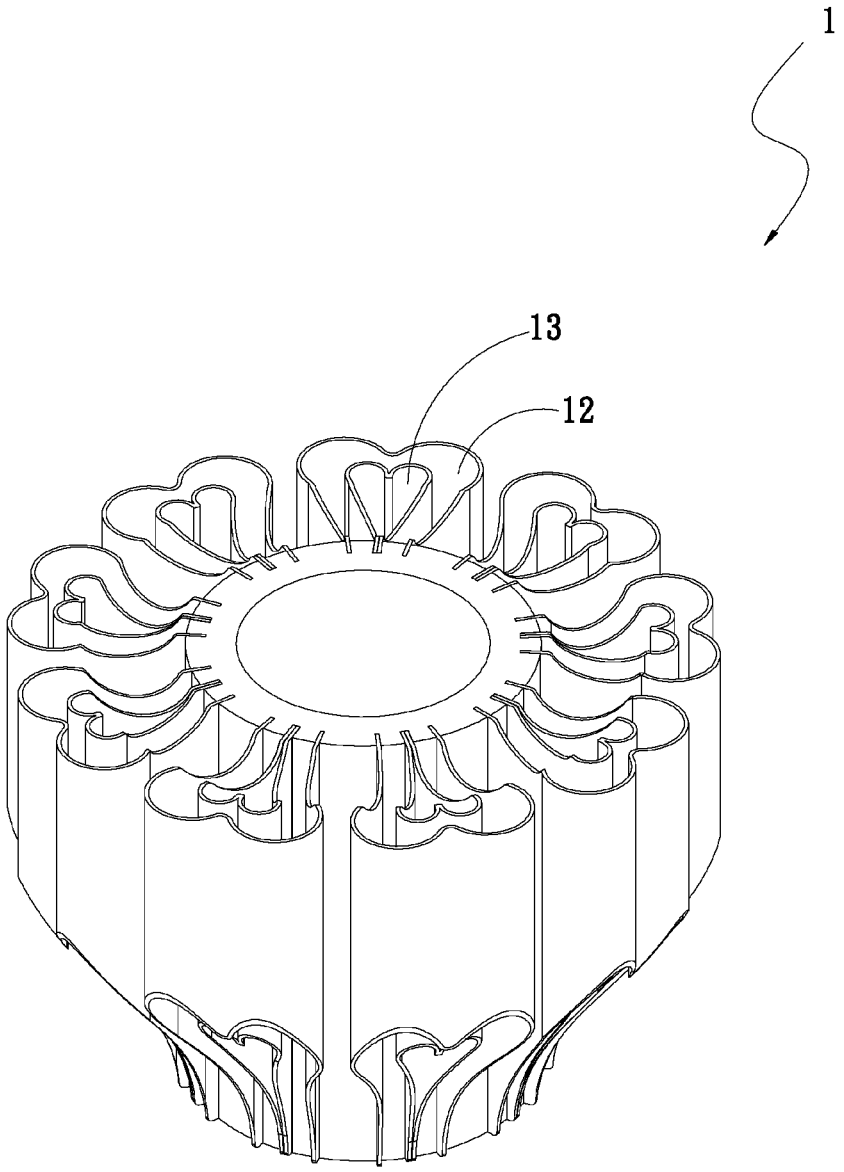
FIG. 6 is an assembled perspective view showing the heat-dissipating device according to the third embodiment of the present invention.

FIGS. 5 and 6 are an exploded perspective view and an assembled perspective view showing the heat-dissipating device according to the third embodiment of the present invention respectively. As shown in these figures, the structure of the second embodiment is substantially the same as that of the first embodiment, so that the redundant description is omitted for clarity. The difference between the third embodiment and the first embodiment lies in that: the heat-dissipating device 1 further has a second heat-dissipating fin 13. The second heat-dissipating fin 13 has a second heat-dissipating portion 131, a third end 132 and a fourth end 133. The third end 132 and the fourth end 133 are provided on both ends of the second heat-dissipating portion 131 respectively. The trough 111 further has a third insertion slot 1113. The first insertion slot 1111 and the second insertion slot 1112 are provided on two adjacent sides of the third insertion slot 1113 respectively. The first end 122 and the second end 123 of the first heat-dissipating fin 12 are inserted into the first insertion slot 1111 and the second insertion slot 1112 respectively. The third end 132 and the fourth end 133 of the second heat-dissipating fin 13 are inserted into the third insertion slot 1113. The first heat-dissipating portion 121 and the second heat-dissipating portion 131 are configured as any one of a curved shape, a pointed shape, a recessed shape, a waved shape, and a linear shape. In the present embodiment, the first heat-dissipating portion 121 and the second heat-dissipating portion 131 are configured as a curved shape, but they are not limited thereto. The first heat-dissipating fin 12 is provided outside the second heat-dissipating fin 13 in such a manner that a first space 124 is formed between the first heat-dissipating fin 12 and the second heat-dissipating fin 13.

Figure 7:
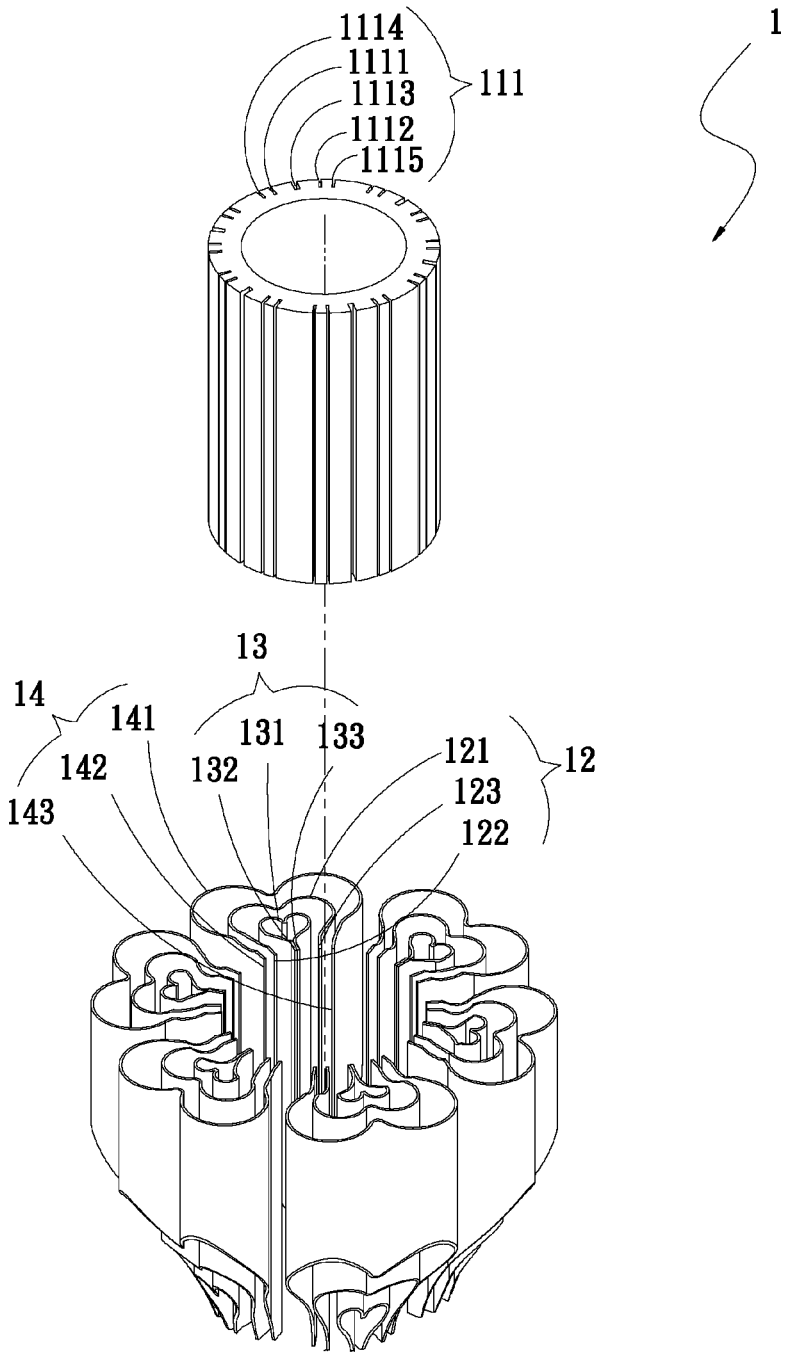
FIG. 7 is an exploded perspective view showing the heat-dissipating device according to a fourth embodiment of the present invention.
Figure 8:
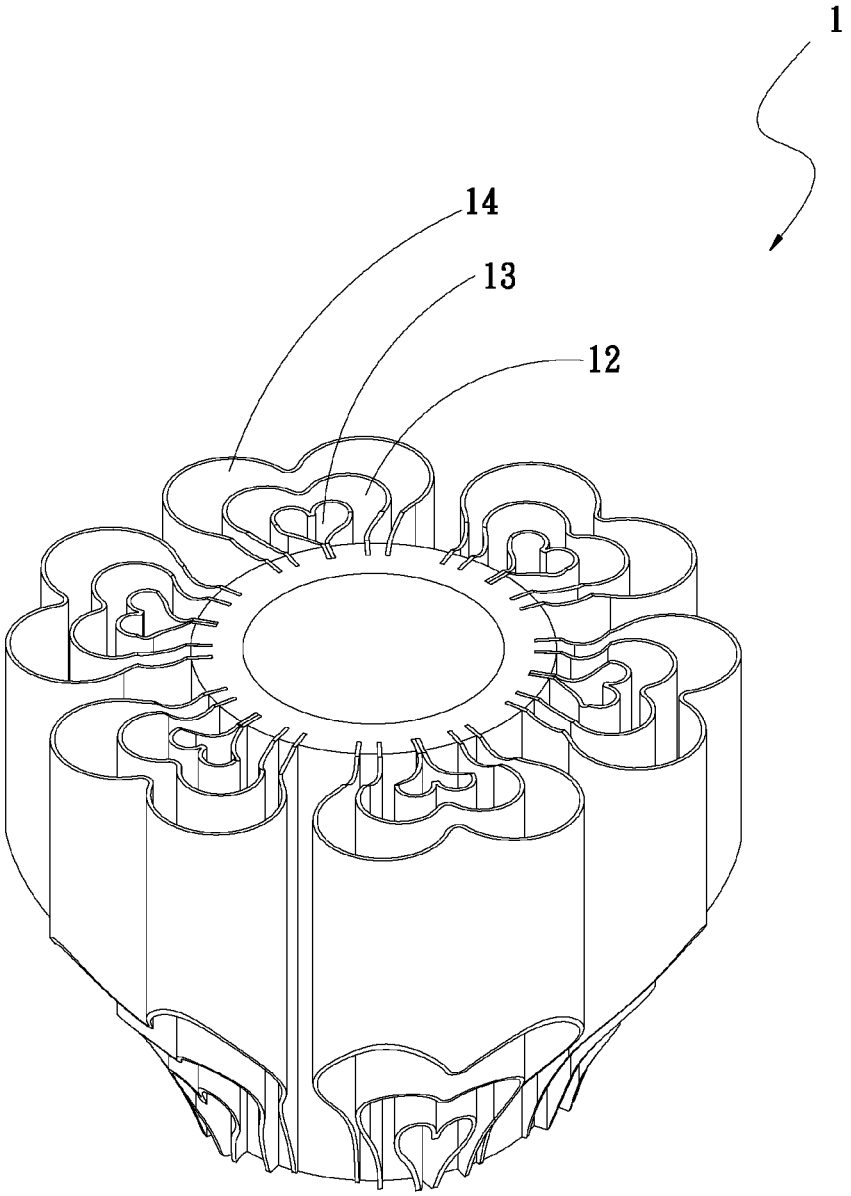
FIG. 8 is an assembled perspective view showing the heat-dissipating device according to the fourth embodiment of the present invention.

FIGS. 7 and 8 are an exploded perspective view and an assembled perspective view showing the heat-dissipating device according to the fourth embodiment of the present invention respectively. As shown in these figures, the structure of the fourth embodiment is substantially the same as that of the third embodiment, so that the redundant description is omitted for clarity. The difference between the fourth embodiment and the third embodiment lies in that: the heat-dissipating device 1 further has a third heat-dissipating fin 14. The third heat-dissipating fin 14 further has a third heat-dissipating portion 141, a fifth end 142, and a sixth end 143. The fifth end 142 and the sixth end 143 are provided on both ends of the third heat-dissipating portion 141 respectively. The trough 111 further has a fourth insertion slot 1114 and a fifth insertion slot 1115. The first insertion slot 1111 and the second insertion slot 1112 are provided on two adjacent sides of the third insertion slot 1113 respectively. The fourth insertion slot 1114 and the fifth insertion slot 1115 are respectively provided on the opposite two sides of the third insertion slot 1113 relative to the first insertion slot 111 and the second insertion slot 1112. The first end 122 and the second end 123 of the first heat-dissipating fin 12 are inserted into the first insertion slot 1111 and the second insertion slot 1112 respectively. The third end 132 and the fourth end 133 of the second heat-dissipating fin 13 are inserted into the third insertion slot 1113 respectively. The fifth end 142 and the sixth end 143 of the third heat-dissipating fin 14 are inserted into the fifth insertion slot 1114 and the fifth insertion slot 1115 respectively. The first heat-dissipating portion 121, the second heat-dissipating portion 131 and the third heat-dissipating portion 141 are configured as any one of a curved shape, a pointed shape, a recessed shape, a waved shape, and a linear shape. In the present embodiment, they are configured as a curved shape, but they are not limited thereto.

Figure 9:
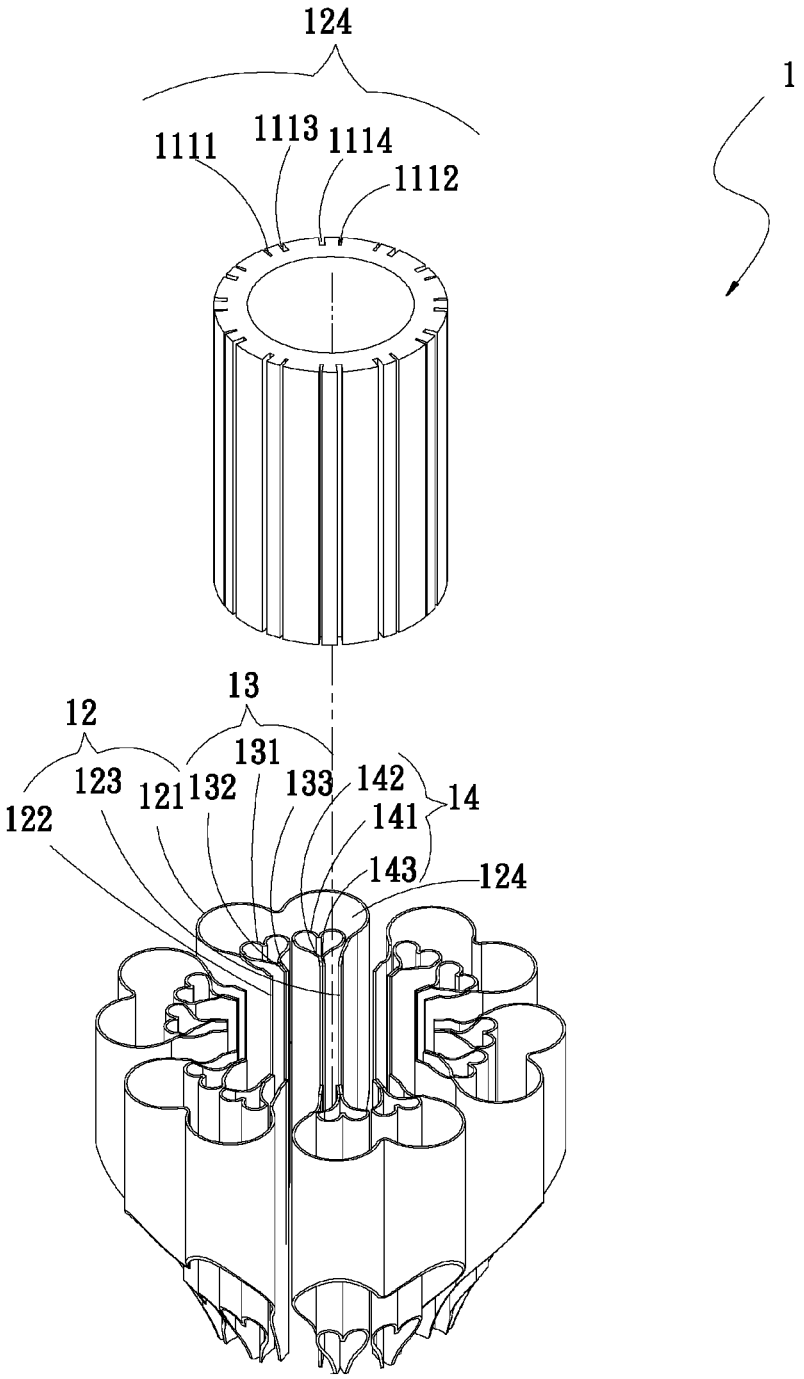
FIG. 9 is an exploded perspective view showing the heat-dissipating device according to a fifth embodiment of the present invention.
Figure 10:
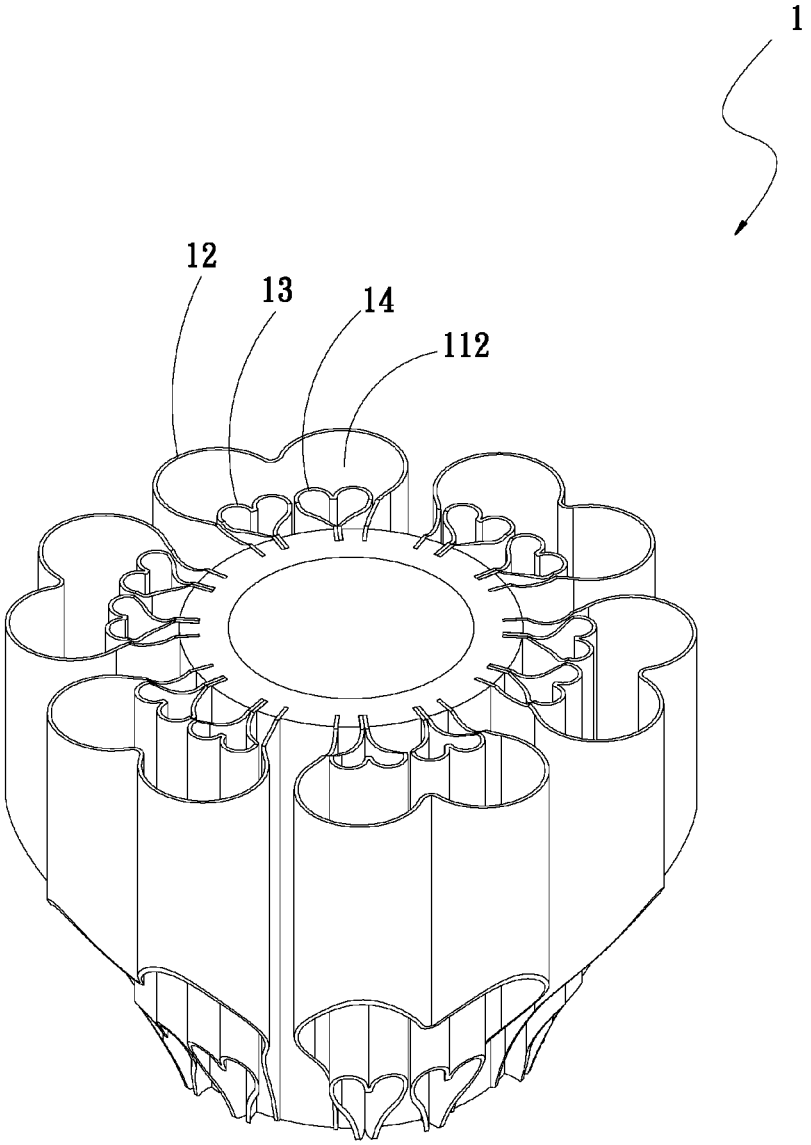
FIG. 10 is an assembled perspective view showing the heat-dissipating device according to the fifth embodiment of the present invention.

FIGS. 9 and 10 are an exploded perspective view and an assembled perspective view showing the heat-dissipating device according to the fifth embodiment of the present invention respectively. As shown in these figures, the structure of the fifth embodiment is substantially the same as that of the third embodiment, so that the redundant description is omitted for clarity. The difference between the fifth embodiment and the third embodiment lies in that: the heat-dissipating device 1 further has a third heat-dissipating fin 14. The third heat-dissipating fin 14 has a third heat-dissipating portion 141, a fifth end 142, and a sixth end 143. The fifth end 142 and the sixth end 143 are provided on both ends of the third heat-dissipating portion 141 respectively. The trough 111 further has a fourth insertion slot 1114. The first insertion slot 1111 and the second insertion slot 1112 are provided on adjacent two sides of the third insertion slot 1113 and the fourth insertion slot 1114 respectively. The first end 122 and the second end 123 of the first heat-dissipating fin 12 are inserted into the first insertion slot 1111 and the second insertion slot 1112 respectively. The third end 132 and the fourth end 133 of the second heat-dissipating fin 13 are inserted into the third insertion slot 1113 respectively. The fifth end 142 and the sixth end 143 of the third heat-dissipating fin 14 are inserted into the fourth insertion slot 1114 respectively. The first heat-dissipating portion 121, the second heat-dissipating portion 131 and the third heat-dissipating portion 141 are configured as any one of a curved shape and a pointed shape. In the present embodiment, they are configured as a curved shape, but they are not limited thereto. The first heat-dissipating fin 12 is provided outside the second heat-dissipating fin 13 and the third heat-dissipating fin 14. The first space 124 is located between the first heat-dissipating fin 12 and the second heat-dissipating fin 13 as well as between the first heat-dissipating fin 12 and the third heat-dissipating fin 14.

Figure 11:
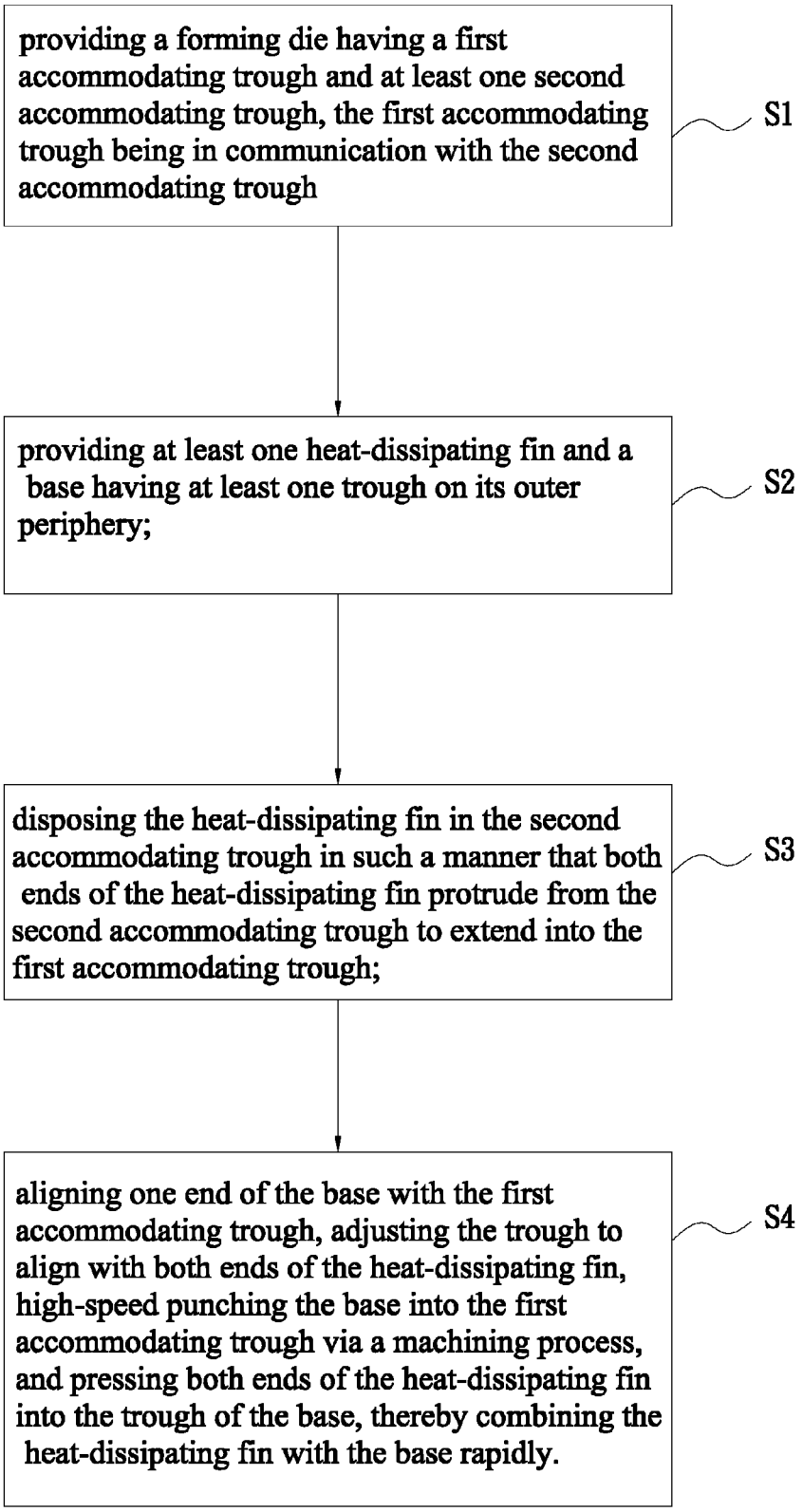
FIG. 11 is a flow chart showing the method for manufacturing the heat-dissipating device of the present invention.

FIG. 11 is a flow chart showing the method for manufacturing the heat-dissipating device of the present invention. FIGS. 12 to 17 are schematic view showing the machining process used in the method for manufacturing the heat-dissipating device of the present invention. Please also refer to FIGS. 1 to 10. The method for manufacturing the heat-dissipating device of the present invention includes steps as follows:

In a step S1, a forming die is provided. The forming die has a first accommodating trough and at least one second accommodating trough. The first accommodating trough is in communication with the second accommodating trough.

A forming die 2 is provided. The forming die 2 has a first accommodating trough 21 and a second accommodating trough 22. The second accommodating trough 22 is provided on an outer periphery of the first accommodating trough 21 and in communication with the first accommodating trough 21.

In a step S2, a heat-dissipating fin and a base having at least one trough on its outer periphery are provided.

A heat-dissipating fin 3 (equivalent to the first heat-dissipating fin 12 shown in FIGS. 1 to 10) is provided. The heat-dissipating fin 3 is configured as any one of a curved shape, a pointed shape, a recessed shape, a waved shape, and a linear shape. The shape of the heat-dissipating fin 3 corresponds to that of the second accommodating trough 22 of the forming die 2.

Further, a base 4 (equivalent to the base 11 shown in FIGS. 1 to 10) is provided. The outer periphery of the base 4 is provided in advance with at least one trough 41 (equivalent to the trough 111 shown in FIGS. 1 to 10).

In a step S3, the heat-dissipating fin is disposed in the second accommodating trough. Both ends of the heat-dissipating fin protrude from the second accommodating trough to extend into the first accommodating trough.

The heat-dissipating fin 3 is disposed in the second accommodating trough 22. Both ends of the heat-dissipating fin 3 protrude into the first accommodating trough 21.

In a step 4, one end of the base is aligned with the first accommodating trough. The trough is aligned with both ends of the heat-dissipating fin. The base is punched into the first accommodating trough at a high speed by a machining process. In this way, both ends of the heat-dissipating fin are pressed into the trough of the base, thereby combining the heat-dissipating fin with the base.

In the machining process, a compressed air machine 5 is used to generate compressed air to act as a power source. One end of the base 4 is aligned with the first accommodating trough 21. Then, the trough 41 of the base 4 is adjusted to be aligned with both ends of the heat-dissipating fin 3. The compressed air releases its pressure to generate a power to thereby push the base 4 into the first accommodating trough 21 at a high speed. At this time, both ends of the heat-dissipating fin 3 are combined with the base 4, thereby forming the heat-dissipating device 1 shown in the first to fifth embodiments. The compressed air machine 5 are, for example, not limited to an air compressor.

Figure 12:
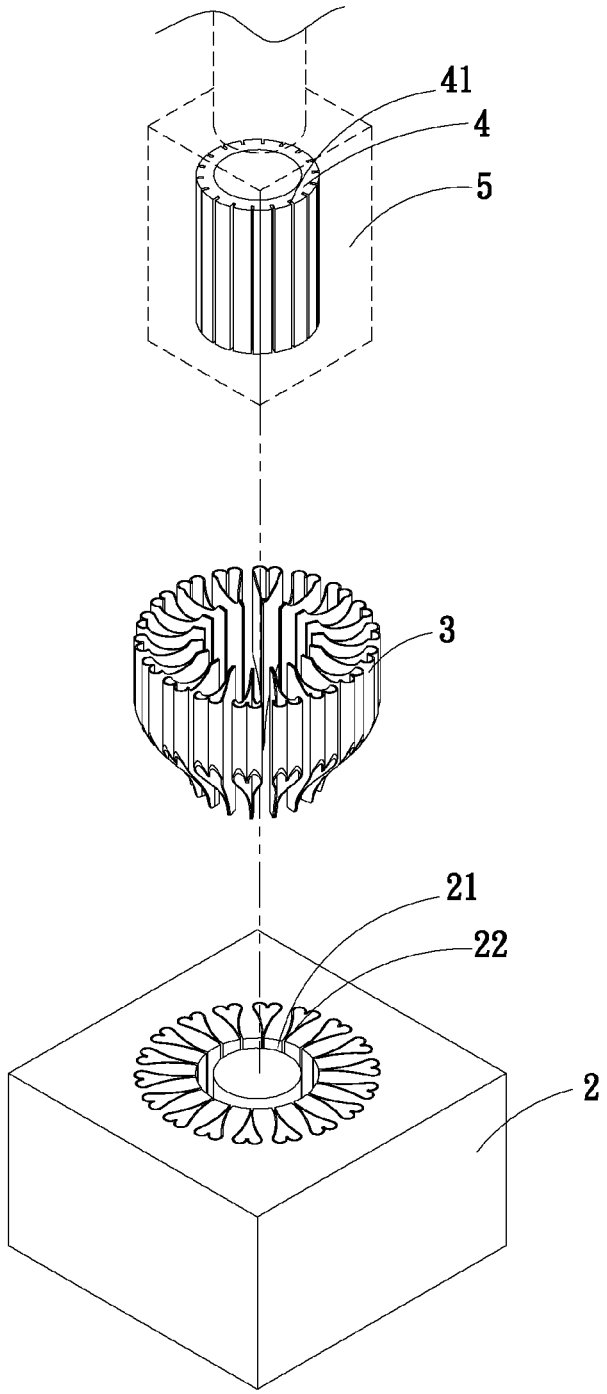
FIG. 12 is a schematic view showing the machining process used in the method for manufacturing the heat-dissipating device of the present invention.
Figure 13:
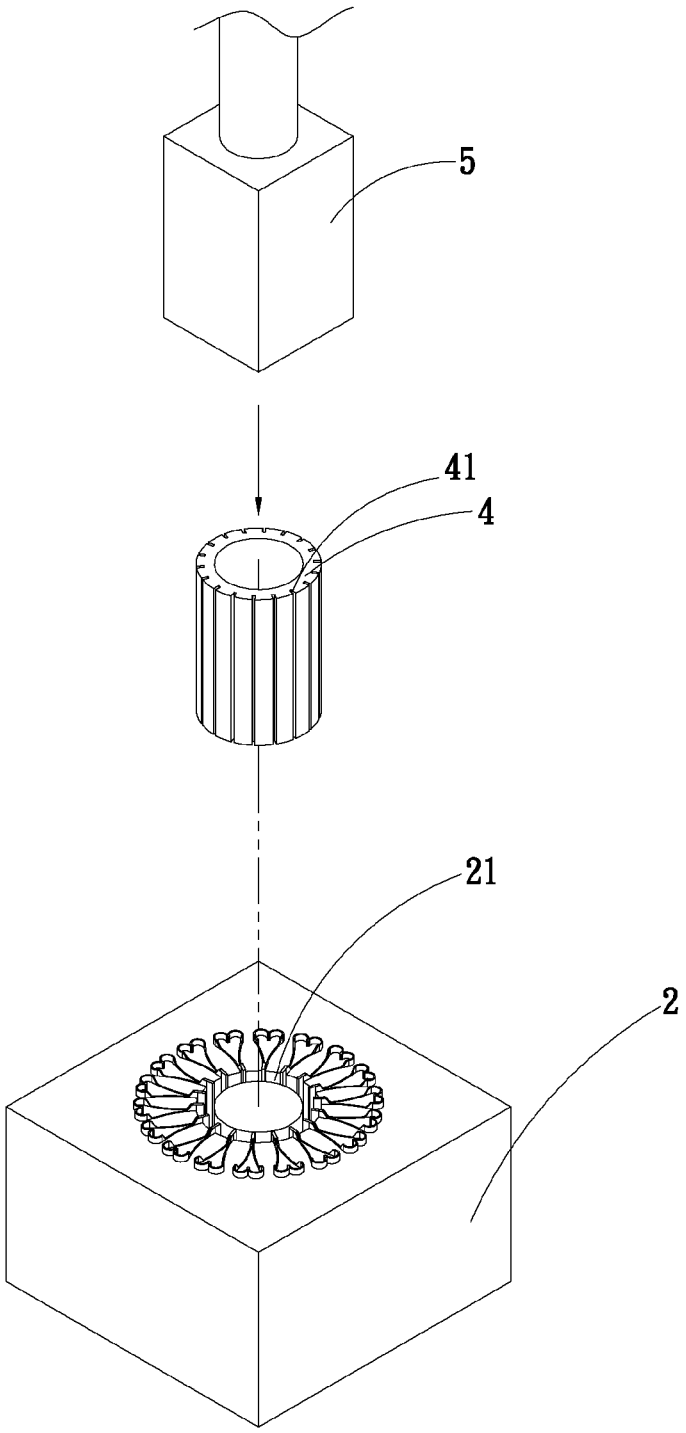
FIG. 13 is a schematic view showing the machining process used in the method for manufacturing the heat-dissipating device of the present invention.
Figure 14:
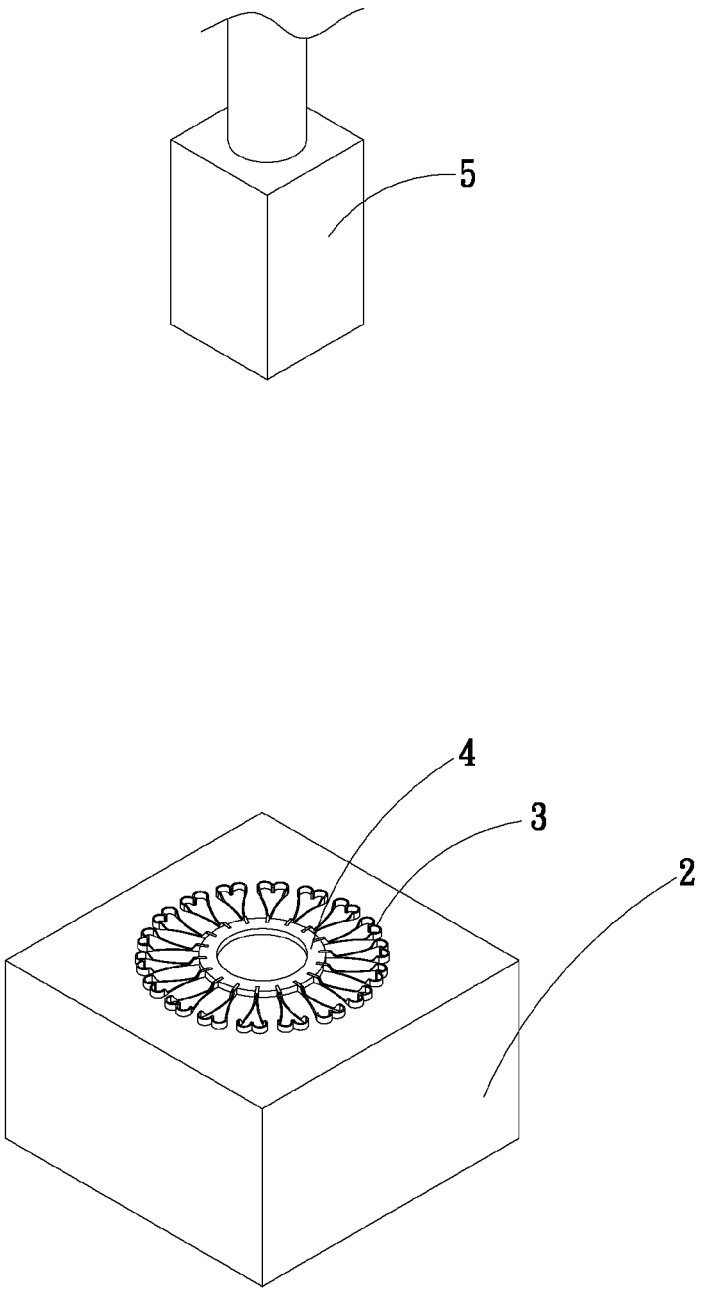
FIG. 14 is a schematic view showing the machining process used in the method for manufacturing the heat-dissipating device of the present invention.

In order to manufacture the heat-dissipating device shown in the second embodiment, both ends of the heat-dissipating fin 3 (such as the first end 122 and the second end 123 of the first heat-dissipating fin 12 shown in FIGS. 3 and 4) are arranged to be adjacent to the trough 41. The compressed air machine 5 generates compressed air to drive the base 4 into the first accommodating trough 21, so that both ends of the heat-dissipating fin 3 can be simultaneously pressed into the trough 41 as shown in FIGS. 12 to 14.

Figure 15:
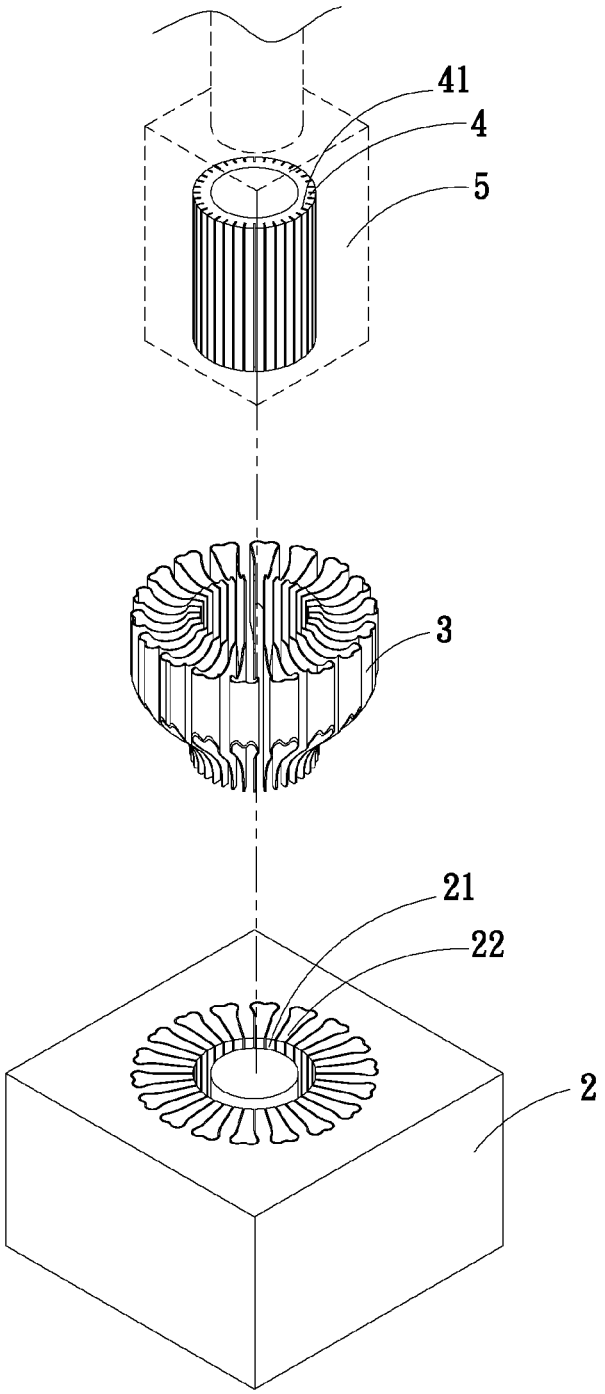
FIG. 15 is a schematic view showing the machining process used in the method for manufacturing the heat-dissipating device of the present invention.
Figure 16:
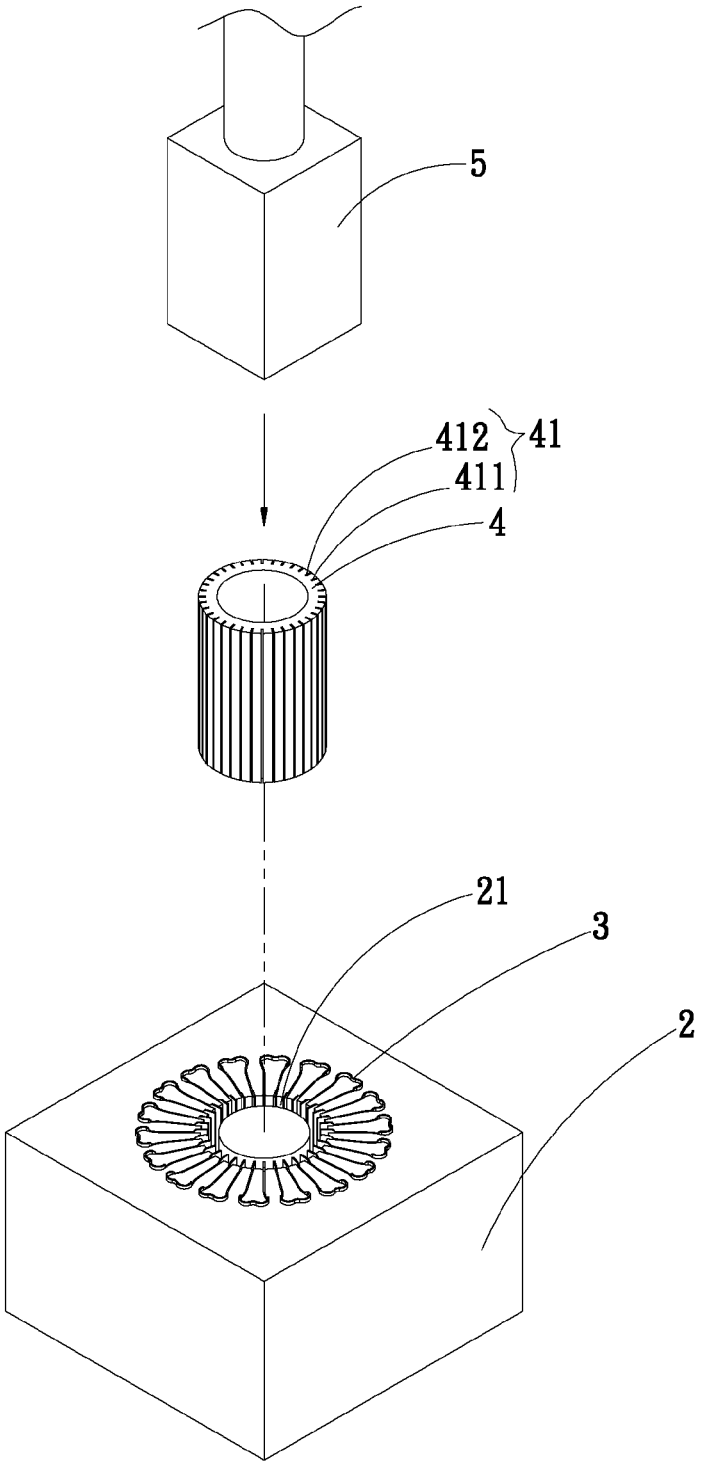
FIG. 16 is a schematic view showing the machining process used in the method for manufacturing the heat-dissipating device of the present invention.
Figure 17:
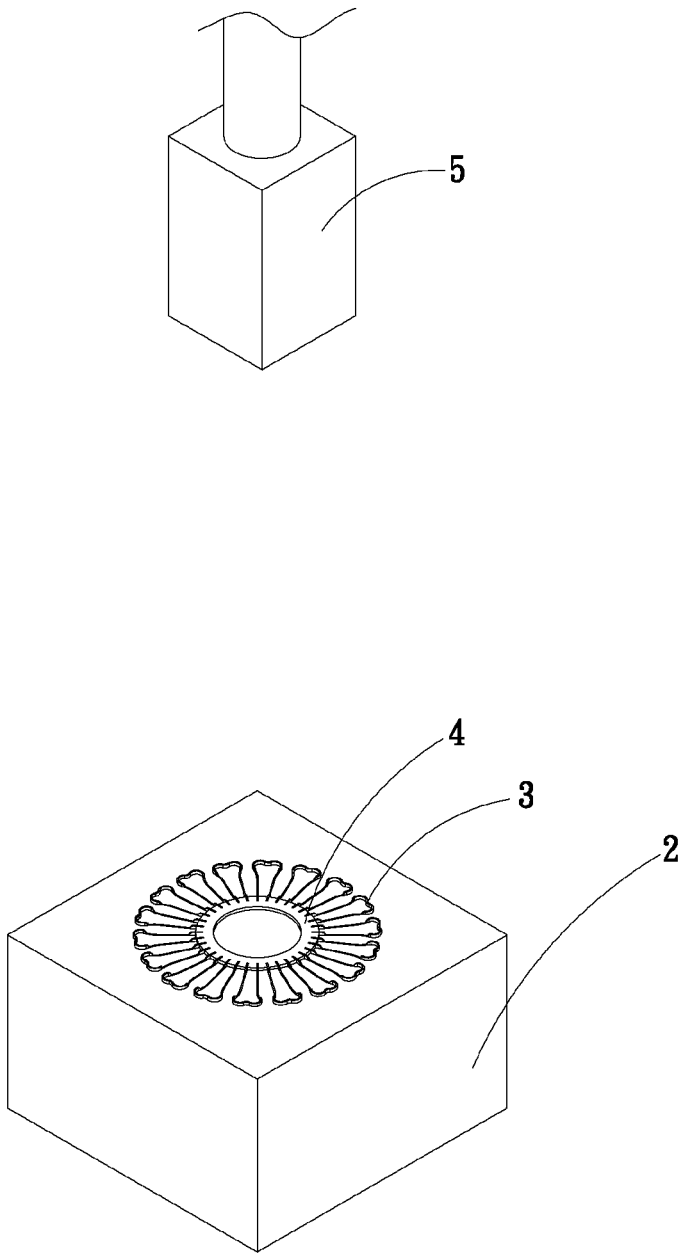
FIG. 17 is a schematic view showing the machining process used in the method for manufacturing the heat-dissipating device of the present invention.
Figure 18:
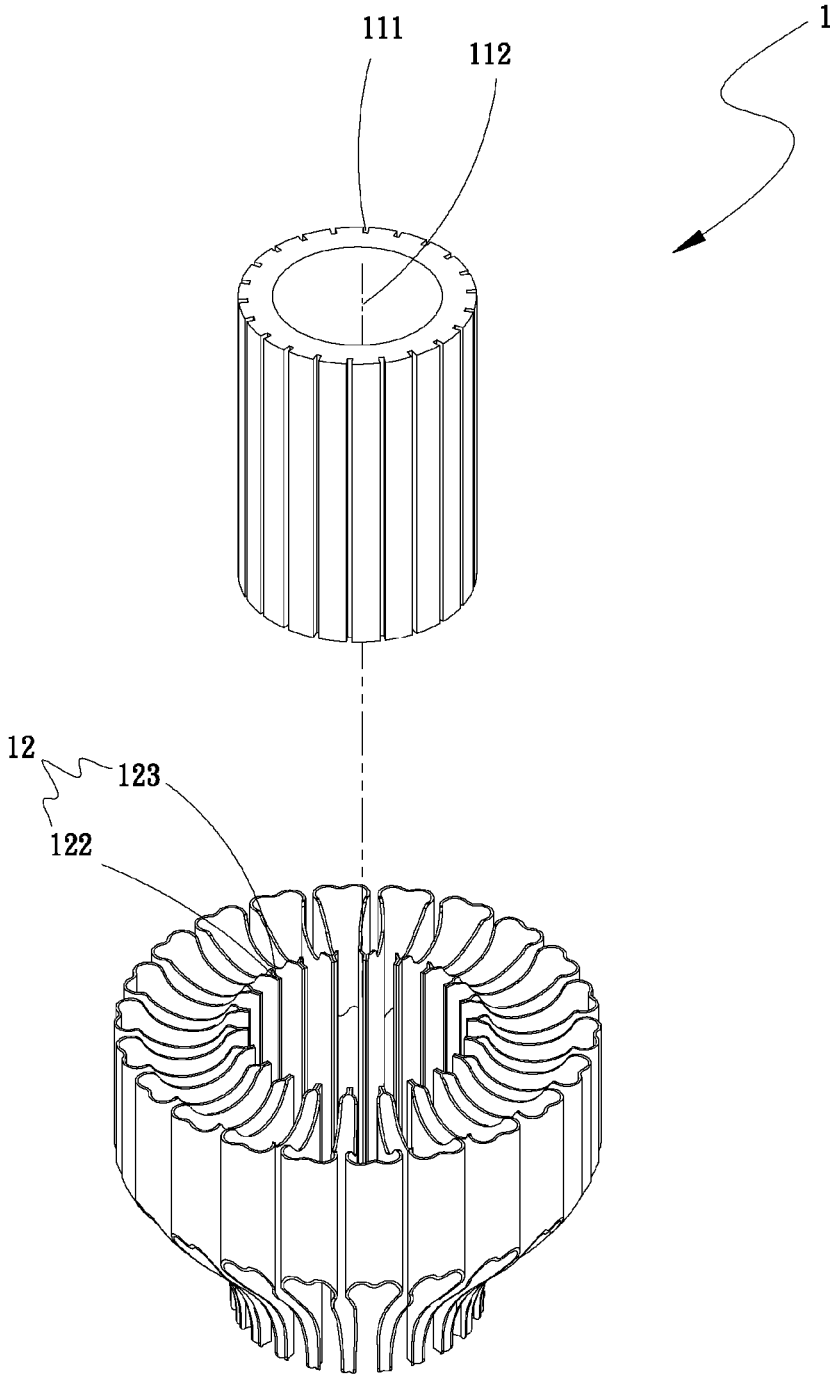
FIG. 18 is an exploded perspective view showing the first end of the first heat-dissipating fin and the second end of another first heat-dissipating fin simultaneously disposed in the trough 111.
Figure 19:
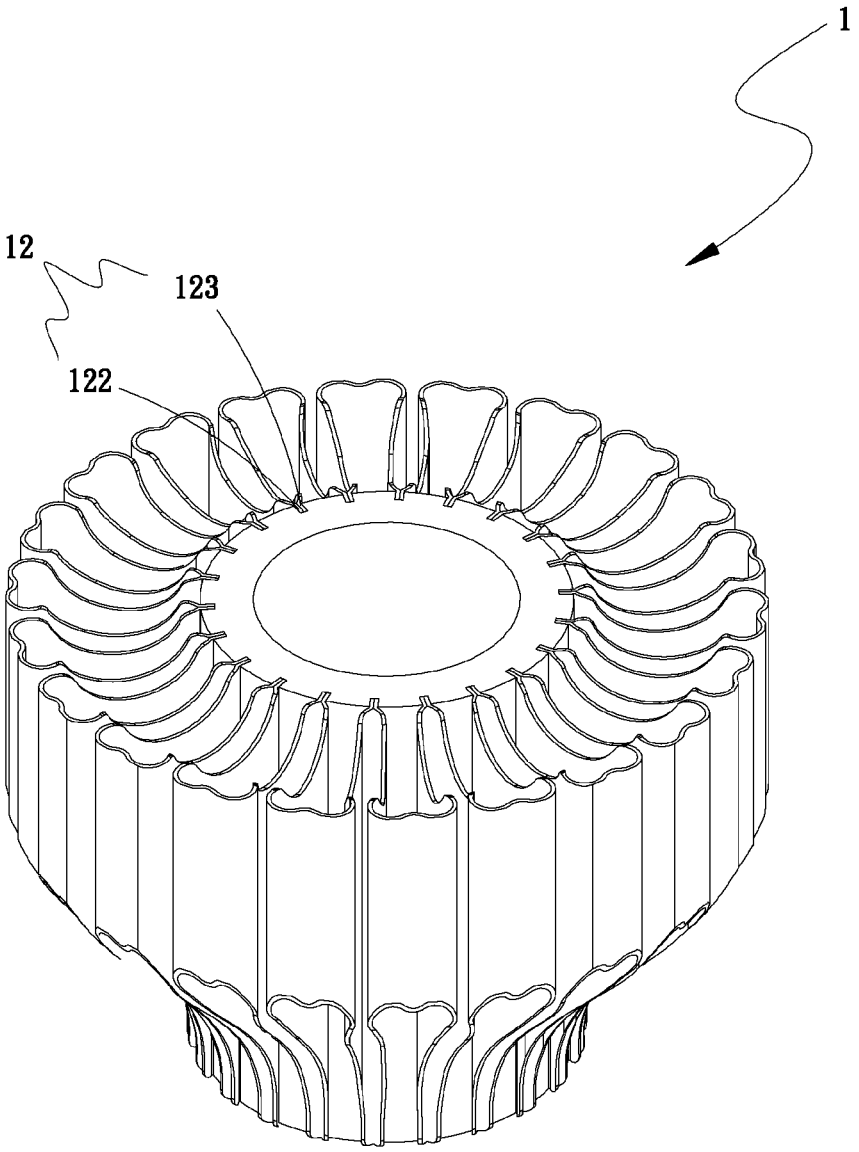
FIG. 19 is an assembled perspective view showing the first end of the first heat-dissipating fin and the second end of another first heat-dissipating fin simultaneously disposed in the trough 111.

In order to manufacture the heat-dissipating device shown in the first embodiment, the trough 41 of the base 4 is provided in advance with a first insertion slot 411 and a second insertion slot 412. Both ends of the heat-dissipating fin 3 (the first end 122 and the second end 123 of the first heat-dissipating fin 12 shown in FIGS. 1 and 2) are inserted into the first insertion slot 411 and the second insertion slot 412 respectively. A compressed air machine 5 is used to generate compressed air to drive the base 4 into the first accommodating trough 21, so that both ends of the heat-dissipating fin 3 can be pressed into the first insertion slot 411 and the second insertion slot 412 respectively as shown in FIGS. 15 to 17.

What is claimed is:

1. A heat-dissipating device, including:

a base having a plurality of troughs on its outer periphery; and a plurality of first heat-dissipating fins, the fins being spaced about the outer periphery and unconnected to each other and having a first heat-dissipating portion, the heat-dissipating portion having a first end and a second end respectively, the first end and the second end being separately connected to said base;

wherein the first end of the first heat-dissipating fin and the second end of another first heat-dissipating fin are simultaneously disposed in a single one of said plurality of troughs.

2. The heat-dissipating device according to claim 1, the first heat-dissipating portion is configured as any one of a curved shape, a pointed shape, a recessed shape, a waved shape, and a linear shape.

3. The heat-dissipating device according to claim 1, wherein a central axis is defined in the base, the trough is formed by extending parallel to the central axis.

* * * * *